US005672392A

United States Patent [19]

De Clercq et al.

[11] Patent Number: 5,672,392

[45] Date of Patent: Sep. 30, 1997

[54] PREPARATION OF RECORDING MATERIALS FOR INKJET PRINTERS

[75] Inventors: Arnold De Clercq, Dirmstein; Lothar Höhr, Worms; Ulrich Riebeling, Schifferstadt, all of Germany

[73] Assignee: BASF Aktiengesellschaft, Ludwigshafen, Germany

[21] Appl. No.: 635,973

[22] PCT Filed: Oct. 31, 1994

[86] PCT No.: PCT/EP94/03584

§ 371 Date: May 8, 1996

§ 102(e) Date: May 8, 1996

[87] PCT Pub. No.: WO95/13194

PCT Pub. Date: May 18, 1995

[30] Foreign Application Priority Data

Nov. 11, 1993 [DE] Germany ..... 43 38 486.2

[51] Int. Cl.[6] ..... B05D 3/00

[52] U.S. Cl. ..... 427/391; 427/411

[58] Field of Search ..... 427/411, 414, 427/415, 261, 152, 391, 395

[56] References Cited

U.S. PATENT DOCUMENTS

| | | | |
|---|---|---|---|
| 4,547,405 | 10/1985 | Bedell et al. | 427/261 |
| 4,576,867 | 3/1986 | Miyamoto | 427/261 |
| 4,740,420 | 4/1988 | Akutsa et al. | 427/261 |
| 4,830,911 | 5/1989 | Kojima et al. | 428/342 |
| 4,944,988 | 7/1990 | Yasuda et al. | 427/138 |
| 5,139,614 | 8/1992 | dePierne et al. | 427/391 |
| 5,254,403 | 10/1993 | Malhotra | 427/261 |
| 5,270,103 | 12/1993 | Oliver et al. | 427/361 |
| 5,302,437 | 4/1994 | Idei et al. | 428/195 |
| 5,314,721 | 5/1994 | Müller et al. | 427/391 |
| 5,478,631 | 12/1995 | Kawano et al. | 428/212 |
| 5,565,238 | 10/1996 | Yamamoto | 427/146 |
| 5,591,489 | 1/1997 | Dragner et al. | 427/391 |

FOREIGN PATENT DOCUMENTS

| | | |
|---|---|---|
| B-0 257 412 | 3/1988 | European Pat. Off. . |
| B-0 276 770 | 8/1988 | European Pat. Off. . |
| A-0 387 893 | 9/1990 | European Pat. Off. . |
| A-0 445 327 | 9/1991 | European Pat. Off. . |
| A-30 16 766 | 11/1980 | Germany . |
| A-31 32 248 | 6/1982 | Germany . |

*Primary Examiner*—Diana Dudash

*Attorney, Agent, or Firm*—Oblon, Spivak, McClelland, Maier & Neustadt, P.C.

[57] ABSTRACT

A process for the preparation of recording materials for inkjet printers by applying aqueous coating compositions to one or both sides of a sheet of paper which has been treated with size, where the coating compositions contain from 20 to 200 g/l of starch and from 1 to 50 g/l of a copolymer which is obtainable by emulsion copolymerization of 100 parts by weight of a monomer mixture comprising (a) from 10 to 65 parts by weight of styrene, α-methylstyrene, acrylonitrile and/or methacrylonitrile, (b) from 30 to 85 parts by weight of acrylic and/or methacrylic esters of alcohols having 1 to 18 carbon atoms, (c) from 5 to 25 parts by weight of monomers containing tertiary and/or quaternary amino groups, and (d) from 0 to 20 parts by weight of other monoethylenically unsaturated monomers in an aqueous medium in the presence of from 12 to 300% by weight, based on the monomers, of at least one natural or synthetic protective colloid.

6 Claims, No Drawings

PREPARATION OF RECORDING MATERIALS FOR INKJET PRINTERS

The invention relates to a process for the preparation of recording materials for inkjet printers by applying aqueous coating compositions to one or both sides of a sheet of paper which has been treated with size.

DE-A-30 16 766 discloses recording materials for inkjet printers, which are prepared, for example, by coating a sized paper with a talc-containing aqueous solution of gelatin or with an aqueous solution of hydroxyethylcellulose and polyethyleneimine, and then drying and calendering the coated paper.

DE-A-31 32 248 discloses inker recording materials consisting of a support coated with at least one basic latex polymer. According to the examples, a sheet of sized paper is coated with an aqueous solution, containing aluminum silicate, of unspecified polymers and gelatin, and then passed through a calender.

EP-A-0 387 893 relates to a recording sheet for inkjet printers. The recording sheet consists of a base layer which on one side has an ink-receiving layer and on the other side has a layer which prevents penetration of the ink.

The subject of EP-A-0 445 327 is a recording material suitable for the inkjet printing method that consists of a sized base paper with a polyolefin coating on one side and with, on the other side, an ink-receiving layer which consists of a mixture of gelatin and rice starch.

EP-B-0 257 412 and EP-B-0 276 770 disclose sizing agents for paper which are based on finely divided, aqueous dispersions of copolymers which are obtainable by copolymerizing ethylenically unsaturated monomers by emulsion polymerization in the presence of degraded starches. The monomer mixtures which are polymerized in the aqueous solution of a degraded starch comprise (a) from 20 to 65% by weight of acrylonitrile and/or methacrylonitrile, (b) from 80 to 35% by weight of an acrylic ester of a monohydric saturated $C_3$–$C_8$ alcohol and (c) from 0 to 10% by weight of other ethylenically unsaturated copolymerizable monomers.

Monomers of group c) which can also be employed if desired are monomers containing tertiary and/or quaternary amino groups. The sizing agents can be employed in both the engine sizing and the surface sizing of paper.

It is an object of the present invention to provide a process for the preparation of inexpensive recording materials for inkjet printers. The recording materials are to ensure a high ink density and good water resistance of the inkjet-printed image.

We have found that this object is achieved, in accordance with the invention, by a process for the preparation of recording materials for inkjet printers by applying aqueous coating compositions to one or both sides of a sheet of paper which has been treated with size, using as coating composition an aqueous dispersion containing from 20 to 200g/l of starch and from 0.5 to 50 g/l of a copolymer which is obtainable by emulsion copolymerization of 100 parts by weight of a monomer mixture comprising (a) from 10 to 65 parts by weight of styrene, α-methylstyrene, acrylonitrile and/or methacrylonitrile, (b) from 30 to 85 parts by weight of acrylic and/or methacrylic esters of alcohols having 1 to 18 carbon atoms, (c) from 5 to 25 parts by weight of monomers containing tertiary and/or quaternary amino groups, and (d) from 0 to 20 parts by weight of other monoethylenically unsaturated monomers in an aqueous medium in the presence of from 12 to 300% by weight, based on the monomers, of at least one natural or synthetic protective colloid, and if synthetic cationic protective colloids are used it is also possible to carry out the emulsion copolymerization in the absence of monomers of group (c).

The paper which is coated according to the invention can be composed of any known base materials for papermaking: use can be made, for example, of ground wood, thermomechanical pulp (TMP), chemothermomechanical pulp (CTMP), pressure-ground pulp (PGW) and sulfite and sulfate pulp, each of which can be short- or long-fibered and bleached or unbleached. Cellulose can also be used as a raw material for the production of the pulp. Suitable supports for the recording materials include both filled and unfilled papers. The content of filler in the paper can be up to a maximum of 30% by weight, and is preferably in the range from 5 to 25% by weight filler. Examples of suitable fillers are clay, kaolin, chalk, talc, titanium dioxide, calcium sulfate, barium sulfate, alumina, satin white or mixtures of these fillers. The paper used as support for the recording materials for inkjet printers are preferably engine-sized beforehand, but can also be surface sized. The sized paper has, for example, Cobb values of <40 g/m$^2$, preferably from 20 to 25 g/m$^2$. The weight per unit area of the papers is not critical, and is for example in the range from 50 to 120 g/m$^2$.

The paper can be sized with any conventional sizing agents, for example with resin size, fatty alkyl diketenes or polymer sizes which are described, for example, in EP-B 0 257 412 or in EP-B-0 276 770. The novel process for the preparation of recording materials for inkjet printers can be coupled directly with papermaking by first of all forming the sheet of paper on the papermaking machine and then treating it directly on one or both sides with the coating mixture to be employed in accordance with the invention, and drying it.

The coating composition, which is applied to one or both sides of the sized paper, consists of an aqueous dispersion containing starch in the abovementioned copolymer. Suitable starches are natural, digested or chemically modified starches, for example wheat starch, rice starch, potato starch, oxidatively degraded starches, cationic starch, hydroxyethyl starch, hydroxypropyl starch, amphoteric starches and acetylated starch.

If the starch is insoluble, it is dissolved by heating in an aqueous medium at temperatures above the gelatinization point of the starch. The coating compositions contain from 20 to 200 g/l, preferably from 60 to 100 g/l, of at least one starch or a starch mixture.

The coating compositions additionally comprise a cationic copolymer which is obtainable by emulsion copolymerization of 100 parts by weight of a monomer mixture comprising (a) from 10 to 65 parts by weight of styrene, α-methylstyrene, acrylonitrile and/or methacrylonitrile, (b) from 30 to 85 parts by weight of acrylic and/or methacrylic esters of alcohols having 1 to 18 carbon atoms, (c) from 5 to 25 parts by weight of monomers containing tertiary and/or quaternary amino groups, and (d) other monoethylenically unsaturated monomers in an aqueous medium in the presence of from 12 to 300% by weight, based on the monomers, of at least one natural or synthetic protective colloid, and if synthetic cationic protective colloids are used it is also possible to carry out the emulsion copolymerization in the absence of monomers of group (c). Monomers of group (a) are styrene, α-methylstyrene, acrylonitrile and/or methacrylonitrile. It is preferred to employ styrene and acrylonitrile. 100 parts by weight of the monomer mixture used for the polymerization contain from 10 to 65 parts by weight, preferably from 20 to 50 parts by weight, of at least one monomer of group (a).

Suitable monomers of group (b) are all acrylic and/or methacrylic esters of alcohols having 1 to 18 carbon atoms, for example methyl acrylate, ethyl acrylate, isobutyl acrylate, n-propyl acrylate, methyl methacrylate, ethyl methacrylate, isobutyl methacrylate, n-butyl methacrylate, n-butyl acrylate, isobutyl acrylate, isobutyl methacrylate, tert-butyl acrylate, tert-butyl methacrylate, 2-ethylhexyl acrylate, 2-ethylhexyl methacrylate, neopentyl esters of acrylic and methacrylic acid, isooctyl acrylate, isooctyl methacrylate, palmityl acrylate, palmityl methacrylate, stearyl acrylate and stearyl methacrylate. Group (b) esters which are preferably employed are acrylic and methacrylic esters of alcohols having 4 to 6 carbon atoms, especially the acrylic and methacrylic esters of n-butanol, sec-butanol and tert-butanol. 100 parts by weight of the monomer mixture used for the copolymerization contain from 30 to 85 parts by weight, preferably from 20 to 80 parts by weight, of a monomer or a mixture of at least two monomers of group (b).

Suitable group (c) monomers are all monomers containing tertiary and/or quaternary amino groups.

These are preferably monomers which comprise a basic nitrogen atom, either in the form of the free bases or in quaternized form, and monomers which have an amido group which can, if appropriate, be substituted. Examples of suitable monomers of this kind are N,N'-dialkylaminoalkyl (meth)acrylates, for example dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, diethylaminopropyl methacrylate, dimethylaminobutyl acrylate, dimethylaminobutyl methacrylate, dimethylaminoneopentyl acrylate, dimethylaminoneopentyl methacrylate. Further suitable basic monomers of this group are N,N'-dialkylaminoalkyl(meth) acrylamides, for example N,N'-di-$C_1$–$C_3$alkylamino-$C_2$–$C_6$-alkyl(meth)acrylamides, such as dimethylaminoethylacrylamide, dimethylaminoethylmethacrylamide, diethylaminoethylacrylamide, diethylaminoethylmethacrylamide, dipropylaminoethylacrylamide, dipropylaminoethylmethacrylamide, dimethylaminopropylacrylamide, dimethylaminopropylmethacrylamide, diethylaminopropylacrylamide, diethylaminopropylmethacrylamide, dimethylaminoneopentylacrylamide, dimethylaminoneopentylmethacrylamide and dialkylaminobutylacrylamide. Further suitable monomers of this group are 4-vinylpyridine, 2-vinylpyridine and/or diallyl(di)alkylamines in which the alkyl group has 1 to 12 carbon atoms. In copolymerization, the abovementioned basic monomers are employed in the form of the free bases, as salts with organic or inorganic acids or in quaternized form. Carboxylic acids suitable for forming salts are, for example, those having 1 to 7 carbon atoms, for example formic acid, acetic or propionic acid, benzenesulfonic acid, p-toluenesulfonic acids or inorganic acids, such as hydrohalic acids, for example hydrochloric acid or hydrobromic acid. The basic monomers mentioned above by way of example can also be employed in quaternized form. Examples of compounds suitable for quaternization are alkyl halides having 1 to 18 carbon atoms in the alkyl group, for example methyl chloride, methyl bromide, methyl iodide, ethyl chloride, propyl chloride, hexyl chloride, dodecyl chloride, lauryl chloride and benzyl halides, especially benzyl chloride and benzyl bromide. The quaternization of the nitrogen-containing basic monomers can also be undertaken by reacting these compounds with dialkyl sulfates, especially diethyl sulfate or dimethyl sulfate. Examples of quaternized monomers from this group are trimethylammoniumethyl methacrylate chloride, dimethylethylammoniumethyl methacrylate ethyl sulfate and dimethylethylammoniumethylmethacrylamide ethyl sulfate. Other suitable monomers are 1-vinylimidazolium compounds of the formula

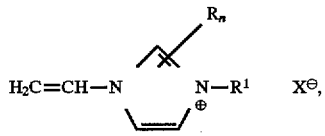

in which $R^1$=H, $C_1$–$C_{18}$-alkyl or benzyl and $X^{\ominus}$ is an anion and R=$CH_3$ or $C_2H_5$ and n=1 to 3.

The anion can be a halide anion or else a radical of an inorganic or organic acid. Examples of quaternized 1-vinylimidazoles of the formula I are 3-methyl-1-vinylimidazolium chloride, 3-benzyl-1-vinylimidazolium chloride, 3-n-dodecyl-1-vinylimidazolium bromide and 3-n-octadecyl-1-vinylimidazolium chloride. Instead of the quaternized vinylimidazolium compounds it is also possible to employ the nonquaternized compounds or salts thereof in the copolymerization.

Preferred group (c) monomers which are employed are vinylimidazole, methylvinylimidazole, dimethylaminoethyl acrylate, methacrylamidopropyldimethylamine and the corresponding quaternized products. The monomers of group (c) can be employed in the copolymerization either alone or in mixtures with one another. 100 parts by weight of the monomer mixture contain from 5 to 25 parts by weight, preferably from 6 to 20 parts by weight, of at least one monomer of group (c).

Suitable monomers of group (d) are other monoethylenically unsaturated monomers, which are different from the monomers of groups (a) to (c). Group (d) monomers which are preferably used are acrylic acid, methacrylic acid, acrylamide and/or methacrylamide. The monomers of group (d) are used in the emulsion copolymerization, if appropriate, in order to modify the copolymers comprising the monomers (a) to (c). The quantities of group (d) monomers make up from 0 to 20 parts by weight, preferably from 0 to 15 parts by weight, per 100 parts by weight of the monomer mixture employed in the copolymerization.

The monomers are copolymerized by emulsion copolymerization in an aqueous medium in the presence of polymerization initiators, which decompose into free radicals under the polymerization conditions, and in the presence of from 12 to 300% by weight, based on the monomers, of at least one natural or synthetic protective colloid. Suitable natural protective colloids are all water-soluble proteins, partially degraded proteins, water-soluble cellulose ethers, native starches, degraded starches and/or chemically modified starches. Suitable water-soluble proteins are, for example, gelatin and casein. Partially degraded proteins which are soluble in water can be obtained from water-insoluble or water-soluble proteins and are, for example, degraded gelatin, degraded soya protein and degraded wheat protein.

Examples of water-soluble cellulose esters are hydroxyethylcellulose and methylcellulose.

Other natural protective colloids are natural starches which are obtainable by heating in an aqueous medium at temperatures above the gelatinization point of the starches. Also suitable are degraded starches which are obtainable by hydrolytic, oxidative or enzymatic degradation, and chemically modified starches, such as hydroxyethylstarch or hydroxypropylstarch. The degraded and chemically modified starches usually have a viscosity $\eta_i$ of from 0.04 to 0.5 dl/g, preferably from 0.05 to 0.45 dl/g.

Examples of suitable synthetic protective colloids are polyvinyl alcohol, polyvinylpyrrolidone and/or water-soluble cationic copolymers which contain tertiary and/or quaternary amino groups. Polyvinyl alcohol and polyvinylpyrrolidone can each have molecular weights in the range of, for example, from 10,000 to 50,000. Like the other protective colloids, they are soluble in water. Further suitable protective colloids are cationic copolymers which can be prepared by solution polymerization of monomer mixtures comprising (1) from 40 to 80% by weight of styrene, acrylonitrile, methacrylonitrile and/or acrylic or methacrylic esters of $C_4$–$C_{18}$ alcohols, (2) from 15 to 50% by weight of a monomer containing tertiary and/or quaternary amino groups, and (3) from 5 to 25% by weight of acrylic acid, methacrylic acid, acrylamide and/or methacrylamide in saturated $C_1$–$C_5$-carboxylic acids, in esters of these carboxylic acids with saturated $C_1$–$C_6$ alcohols, in saturated $C_1$–$C_6$ alcohols and/or in saturated ketones. The solution polymerization is preferably carried out in acetic acid. Examples of other customary solvents for solution polymerization are formic acid, isopropanol, isobutanol, n-butanol, acetone, methyl ethyl ketone, diethyl ketone, cyclohexanone, ethyl acetate, propyl acetate, n-butyl acetate, sec-butyl acetate and/or ethyl propionate. A process of this kind is disclosed, for example, in EP-B-0 051 144.

If the cationic copolymers described above are employed as protective colloids in the preparation of the copolymers which are present in the coating compositions, then the copolymers can comprise only the monomers of groups (a) and (b) in copolymerized form. They can then, therefore, be prepared in the absence of monomers of group (c) by emulsion copolymerization of monomer mixtures comprising (a) and (b).

Natural protective colloids which are preferably employed are hydroxyethylcellulose, hydroxyethylstarch and/or hydroxypropyl-starch.

Preferred synthetic cationic protective colloids are prepared by solution polymerization in acetic acid of monomer mixtures comprising (1) from 40 to 80% by weight of styrene, acrylonitrile and/or acrylic or methacrylic esters of $C_4$–$C_8$ alcohols, (2) from 15 to 50% by weight of vinylimidazole, methylvinylimidazole, dimethylaminoethyl acrylate, diethylaminoethyl acrylate, dimethylaminoethyl methacrylate, diethylaminoethyl methacrylate, dimethylaminopropyl acrylate, dimethylaminopropyl methacrylate, dimethylaminoethylacrylamide, dimethylaminoethylmethacrylamide, diethylaminoethylacrylamide and/or diethylaminoethylmethacrylamide or the corresponding neutralized or quaternized monomers, and (3) from 5 to 25% by weight of acrylic acid, methacrylic acid, acrylamide and/or methacrylamide.

In the emulsion copolymerization, the protective colloids are preferably employed in quantities of from 25 to 160% by weight, based on the monomers. By the process of emulsion copolymerization, aqueous dispersions are obtained which usually have solids contents of from 5 to 50% by weight, preferably from 10 to 35% by weight. This solids content consists of finely divided copolymers which are each coated with a shell of protective colloid. The diameter of the dispersed particles is usually from 30 to 250 μm, preferably from 35 to 200 μm. The emulsion copolymerization is carried out in the presence of customary polymerization initiators which are employed in the customary quantities. Examples of suitable initiators are hydrogen peroxide, ammonium and alkali metal peroxodisulfates, organic peroxides, hydroperoxides and azo compounds. The emulsion copolymerization can if desired be carried out in the presence of polymerization regulators, so as to regulate the molecular weight of the copolymers. Examples of suitable molecular weight regulators are alcohols such as isopropanol and sulfur-containing regulators, such as tert-butylmercaptan, mercaptoacetic acid, mercaptopropionic acid and dodecylmercaptan. The polymer dispersions which are obtainable in the case of emulsion copolymerization are, in order to prepare the solutions which are to be used in accordance with the invention as coating compositions, generally diluted with water, or are added to an aqueous solution containing dissolved starch. The coating compositions obtainable in this way contain, in addition to starch, from 1 to 50 g/l, preferably from 2.5 to 30 g/l, of a copolymer which is obtainable by emulsion copolymerization.

The coating compositions can if desired also contain finely divided pigments. Examples of appropriate pigments are calcium carbonate, chalk, precipitated chalk, clay, titanium dioxide, barium sulfate and gypsum. The particle diameter of the pigments is usually below 20 μm, preferably in the range from 0.2 to 3 μm. The coating mixture can if desired contain one or more different pigments. The quantity of pigments in the coating composition is, for example, from 0 to 400 g/l.

As already mentioned above, the coating compositions are preferably applied during papermaking to one or both sides of the surface of the paper using in-line application machines. The quantities of emulsion copolymer are, for example, from 0.01 to 0.1 g/m$^2$ per side of the paper surface. In accordance with the process of the invention, papers are obtained which are outstandingly suited to printing with inkjet printers. These papers give the printed image the required brilliance and density and have a high water resistance.

Unless indicated otherwise, the parts and percentages in the examples are by weight. The inkjet printability properties were assessed on the basis of ink density, strikethrough and showthrough on the reverse side (ink density of the reverse side) and the water fastness of the inkjet-printed image (ink density after storage in water). For these tests, the paper was printed in black in a DeskJet PLUS commercial inkjet printer from Hewlett Packard. The ink density of the printed image was determined on a solid ink area using a Gretag D 182 print densitometer from Gretag, 8105 Regensdorf, Switzerland. Showthrough and strikethrough were measured with the same instrument by way of the ink density of the reverse side of the print.

To determine the water fastness, part of the printed image was placed in drinking water at room temperature for 5 minutes. The paper was then dried and the ink density was determined, again using the Gretag D 182.

EXAMPLES Characterization of the auxiliaries employed in the examples:

| Protective colloid | ηi dl/g | Degree of substitution mol/mol glucose unit | Solids content % |
|---|---|---|---|
| Hydroxypropylstarch | 1.07 | 0.1 | 83 |
| Hydroxyethylstarch | 1.23 | 0.1 | 83 |
| Cationic potato starch | 1.5 | 0.047 | 83 |

| | Molecular weight | Degree of substitution mol/mol glucose unit | Solids content % |
|---|---|---|---|
| Hydroxyethylcellulose | | 2.5 | 98 |
| Polyvinyl alcohol Degree of hydrolysis: 88% | 26,000 | | 97 |
| Polyethylene glycol | 9000 | | 100 |

α-Amylase is a relatively heat-resistant amylase. Using 16.7 mg of 100% pure α-amylase it is possible, in from 7 to 20 minutes at 37° C. and at a pH of 4.7, to degrade a total of 5.26 g of the starch Amylum Solubile from Merck.

Preparation of the emulsion copolymers

Dispersion 1

338 parts of water are initially introduced into a reaction vessel which is fitted with reflux condenser and stirrer, and are mixed with 0.06 part of calcium acetate, 14.7 parts of a commercial cationic potato starch, 12.05 parts of polyethylene glycol having a mean molecular mass of 9000 and 0.005 part of α-amylase, and the mixture is heated to 85° C. with stirring. After reaching 85° C., 0.085 part of α-amylase is added. After 20 minutes, a mixture of 7.2 parts of acetic acid and 9.6 parts of a 1% strength aqueous solution of iron sulfate (0.096 part) in water is added. 2.8 parts of 30% strength hydrogen peroxide are added and the decomposition of the hydrogen peroxide is awaited. Then 26.8 parts of a 45% strength solution of a vinylimidazole quaternized with dimethyl sulfate, 3.6 parts of acrylic acid and 0.6 part of a 30% strength hydrogen peroxide solution, and a mixture of 42.2 parts of styrene and 42.2 parts of n-butyl acrylate is metered over the course of 2 hours and, separately, an aqueous solution of 52 parts of a 1.62% strength aqueous hydrogen peroxide solution is metered over the course of 2 hours into the reaction mixture. 1 hour after the end of addition of hydrogen peroxide, the reaction mixture is stirred again at 85° C. and then cooled. An aqueous dispersion is obtained which has a solids content of 18.1%. The dispersion has an LD value of 73.

Dispersion 2

292 parts of water, 0.07 part of calcium acetate, 15.1 parts of a cationic potato starch, 12.5 parts of polyvinyl alcohol having a molecular mass of 26,000 and 0.005 part of α-amylase are initially introduced into a reaction vessel fitted with stirrer and reflux condenser, and the mixture is heated to 85° C. with stirring. As soon as this temperature has been reached, 4.4 parts of a 1% strength aqueous α-amylase solution are added, the reaction mixture is heated at 85° C. for 20 minutes, and then 7.5 parts of glacial acetic acid and 5 parts of a 1% strength aqueous solution of iron(II) sulfate are added in one go. Then 4.1 parts of a 30% strength aqueous hydrogen peroxide solution are added and the reaction mixture is stirred. After 20 minutes, 27.8 parts of a 45% strength aqueous solution of vinylimidazole which is quaternized with dimethyl sulfate, 3.75 parts by weight of acrylic acid and 0.83 part of a 30% strength hydrogen peroxide solution are metered in, and the metered addition of a mixture of 25 parts of styrene and 58.8 parts of n-butyl acrylate is commenced immediately. This mixture is metered in over the course of 2 hours, and, simultaneously therewith over the course of 2.25 hours, 53.5 parts of a 2.1% strength aqueous hydrogen peroxide solution are added. Following the end of the addition of hydrogen peroxide, the reaction mixture is postpolymerized for 1 hour at 85° C. and then cooled. A dispersion is obtained which has a solids content of 22.9%. The dispersion has an LD value of 89.

Dispersion 3

415 parts of water, 0.12 part of calcium acetate, 17.2 parts of a cationic potato starch and 14.9 parts of hydroxyethylcellulose together with 0.6 part of 1% strength aqueous α-amylase solution are initially introduced under nitrogen into a polymerization vessel which is fitted with a reflux condenser and a stirrer, and the mixture is heated with stirring to 85° C. As soon as this temperature has been reached, 0.6 part by weight of 1% strength aqueous α-amylase solution (0.004%) is added. 20 minutes later, a mixture of 8.6 parts of glacial acetic acid and 5.7 parts of a 1% strength aqueous iron(II) sulfate solution is added. 3.3 parts of 30% strength hydrogen peroxide are added and its decomposition is awaited. Then 0.71 part of 30% strength hydrogen peroxide is added and the metered addition of a mixture of 28.6 parts of styrene, 50 parts of n-butyl acrylate, 7.14 parts of methacrylic acid and 28.3 parts of a 50% strength aqueous solution of dimethylaminoethyl acrylate quaternized with dimethyl sulfate is commenced immediately. Simultaneously with the monomer addition, which takes place over the course of 2 hours, the addition is begun of 61 parts of a 1.6% strength solution of hydrogen peroxide, over the course of 2.5 hours. Following the addition of the hydrogen peroxide, the reaction mixture is postpolymerized at 85° C. for 1 hour and then cooled. A dispersion is obtained which has a solids content of 17.9% and an LD value of 94.

Dispersion 4

466.2 parts of water, 0.072 part of calcium acetate, 49.5 parts of hydroxyethylstarch and 0.07 part of a-amylase are mixed in a reaction vessel fitted with reflux condenser and stirrer, and the mixture is heated to 85° C. with stirring. As soon as this temperature has been reached, 0.041 part of α-amylase is added and the reaction mixture is stirred for 20 minutes. Then, in order to inactivate the enzyme, a mixture of 8.22 parts of glacial acetic acid and 10.96 parts of a 1% strength aqueous iron(II) sulfate solution is added. 1.14 parts of a 30% strength aqueous solution of hydrogen peroxide are then added and, after 20 minutes, 27.4 parts of 50% strength aqueous solution of methacrylamidopropyltrimethylammonium chloride, 4.1 parts of acrylic acid and 0.91 part of 30% strength hydrogen peroxide. At this point, feeding in of a mixture of 41.1 parts of styrene and 41.1 parts of n-butyl acrylate, and feeding in of 58.4 parts of a 2.1% strength hydrogen peroxide solution, are begun immediately. The monomer feed lasts for 2 hours and that of the hydrogen peroxide 2.25 hours. Following addition of the initiator, the reaction mixture is postpolymerized for 1 hour at 85° C. and then cooled. An aqueous dispersion is obtained which has a solids content of 20.2% and an LD value of 98.

Dispersion 5

222.6 parts of water, 0.072 part of calcium acetate, 49.5 parts of hydroxyethylstarch and 0.68 part of a 1% strength aqueous solution of α-amylase are mixed and this reaction mixture is heated with stirring to 85° C. The hydroxyethyl starch is first of all enzymatically degraded by adding 4.11 parts of a 1% strength aqueous solution of α-amylase over the course of 20 minutes at 85° C. A mixture of 8.22 parts of glacial acetic acid and 11 parts of a 1% strength aqueous solution of iron(II) sulfate in water is then added. Subsequently, 1.14 part of 30% strength hydrogen peroxide is metered in and oxidative degradation is carried out over the course of 20 minutes. Thereafter, 28.4 parts of a 50% strength aqueous solution of methacrylamidopropyltrimethylammonium chloride, 4.1 parts of acrylic acid and 0.91 part of 30% strength hydrogen peroxide are added. Directly following this, a monomer mixture of 41.1 parts of styrene and 41.1 parts of n-butyl acrylate and, separately, the initiator feed of 61 parts of a 2.1% strength hydrogen peroxide solution are added. The addition of the monomer feed is over after 2 hours and that of the hydrogen peroxide after 2.25 hours. Following the end of the addition of initiator, the reaction mixture is postpolymerized for 1 hour. 4.4 parts of a 10% strength aqueous solution of the addition product of sodium bisulfite with formaldehyde are then added over the course of 40 minutes. After cooling, an aqueous dispersion is obtained which has a solids content of 31% and an LD value of 94.

Dispersion 6

As described above, 461 parts of water, 0.07 part of calcium acetate, 51.6 parts of hydroxypropylstarch and 0.72 part of a 1% strength aqueous α-amylase solution are mixed in a reaction vessel and heated with stirring to 85° C. At this temperature, enzymatic degradation is first of all carried out over the course of 20 minutes by adding 4.29 parts of 1% strength aqueous α-amylase solution and then oxidative degradation is carried out over the course of 20 minutes by adding 8.57 parts of glacial acetic acid, 11.4 parts of a 1% strength aqueous iron(II) sulfate solution and 1.19 parts of 30% strength hydrogen peroxide. 0.95 part of 30% strength hydrogen peroxide and 14.3 parts of a 50% strength aqueous solution of methacrylamidopropyltrimethylammonium chloride are then added in one go and the metered addition of a mixture of 42.9 parts of styrene, 42.9 parts of n-butyl acrylate and 14.3 parts of a 50% strength aqueous solution of methacrylamidopropyltrimethylammonium chloride and, separately, the metered addition of 61 parts of a 2.1% strength hydrogen peroxide solution are commenced immediately. The monomers are metered in over the course of 2 hours and the initiator over the course of 2.25 hours. Thereafter, the reaction mixture is postpolymerized for 1 hour and then cooled. An aqueous dispersion is obtained which has a solids content of 20.4% and an LD value of 97.

Dispersion 7

As described above, 469.8 parts of water, 0.072 part of calcium acetate, 43 parts of hydroxypropylstarch and 7.4 parts of hydroxyethylcellulose are mixed and the mixture is heated with stirring to a temperature of 85° C. 0.05 part of α-amylase is added and, after 20 minutes, a mixture of 8.6 parts of glacial acetic acid and 11.4 parts of a 1% strength aqueous iron(II) sulfate solution is also added. Following the addition of 2.3 parts of 30% strength hydrogen peroxide, the reaction mixture is heated to 95° C. Decomposition of the hydrogen peroxide is awaited, and then the mixture is cooled to 85° C. and 37.4 parts of a 50% strength aqueous solution of methacrylamidoethyltrimethylammoniummethosulfate and 1.9 parts of 30% strength hydrogen peroxide are added in one go, followed immediately by the commencement of the metered addition, over 2 hours, of a mixture of 40.7 parts of styrene and 40.7 parts of n-butyl acrylate and, simultaneously but separately, over 2.25 hours, of 61 parts of a 1.4% strength hydrogen peroxide solution. Following the end of the addition of initiator, the reaction mixture was postpolymerized for 1 hour. An aqueous dispersion is obtained which has a solids content of 19.9%. The LD value is 95.

Dispersion 8

As described above, 457 parts of water, 0.06 part of calcium acetate, 43 parts of hydroxypropylstarch, 7.44 parts of hydroxyethylcellulose and 0.007 part of α-amylase are mixed and the mixture is heated with stirring to 85° C. As soon as this temperature has been reached, 4.3 parts of a 1% strength aqueous solution of α-amylase are added. Thereafter, a mixture of 8.5 parts of glacial acetic acid and 11.4 parts of a 1% strength aqueous iron(II) sulfate solution is added again. Following the addition of 2.4 parts of a 30% strength hydrogen peroxide solution, the reaction mixture is heated at 95° C. until the hydrogen peroxide has decomposed. The temperature is then lowered to 85° C., and 28.6 parts of a 50% strength aqueous solution of acrylamidoethyltrimethylammonium chloride and 0.97 part of a 39% strength aqueous solution of hydrogen peroxide are added to the mixture in one go. Directly following this, the addition is made of a mixture of 47.1 parts of acrylonitrile and 38.6 parts of n-butyl acrylate over the course of 2.25 hours and, simultaneously but separately from the monomer feed, of 61 parts of a 2.11% strength solution of hydrogen peroxide. After the customary postpolymerization and cooling, an aqueous dispersion is obtained which has a solids content of 20% and an LD value of 91.

Dispersion 9

469.8 parts of water, 0.072 part of calcium acetate, 43 parts of hydroxypropylstarch and 7.4 parts of hydroxyethylcellulose are mixed under nitrogen in a reaction vessel fitted with reflux condenser and stirrer, and the mixture is heated with stirring to a temperature of 85° C. Then 0.05 part of α-amylase is added. After 20 minutes, a mixture of 8.6 parts of glacial acetic acid and 11.4 parts of a 1% strength aqueous solution of iron(II) sulfate is added. Following the addition of 2.3 parts by weight of 30% strength hydrogen peroxide, the contents of the flask are heated at 95° C. until the hydrogen peroxide is decomposed. Thereafter, the temperature is lowered to 85° C. Following the addition of 31.7 parts of a 45% strength aqueous solution of vinylimidazole which is quaternized with dimethyl sulfate, and 0.95 part of 30% strength hydrogen peroxide, the metered addition of a monomer mixture comprising 42.9 parts of styrene and 42.9 parts of n-butyl acrylate is commenced immediately, as is the metered addition of the initiator feed comprising 61 parts of a 2.1% strength hydrogen peroxide solution. The feed times are as in the preparation of dispersion 10. Subsequently, over the course of 40 minutes, 2.9 parts by weight of a 10% strength aqueous solution of the adduct of sodium bisulfate and formaldehyde are added, and then the reaction mixture is cooled. An aqueous dispersion is obtained which has a solids content of 20.4% and an LD value of 94.

Dispersion 10

524.7 parts of water, 0.072 part of calcium acetate, 71.2 parts of hydroxypropylstarch and 8.8 parts by weight of hydroxyethyl-cellulose are mixed under nitrogen in a polymerization apparatus fitted with reflux condenser and stirrer, and the mixture is heated with stirring to 85° C. Then 0.06 part of α-amylase is added. After 20 minutes, a mixture of 10.1 parts of glacial acetic acid and 13.5 parts of 1% strength aqueous iron(II) sulfate solution are added. Following the addition of 2.8 parts by weight of 30% strength hydrogen peroxide, the flask is heated at 95° C. until the hydrogen peroxide has decomposed. Thereafter, the temperature is lowered to 85° C. and 37.5 parts of a 45% strength aqueous solution of vinylimidazole which is quaternized with dimethyl sulfate, and 2.23 parts of 30% strength hydrogen peroxide are added to the reaction mixture in one go.

Immediately thereafter, the metered addition of the monomer mixture comprising 41.4 parts of styrene, 20.4 parts of n-butyl acrylate, 20.4 parts of tert-butyl acrylate and 0.68 part of acrylic acid together with 0.17 part of ethylhexyl thioglycolate is commenced. Simultaneously therewith, the feeding-in of 72 parts by weight of a 1.39% strength aqueous hydrogen peroxide solution is started. Feed times and postpolymerization are as described for Dispersion 12. Subsequently, a further 0.57 part of a 30% strength hydrogen peroxide solution is added, 10 minutes are allowed to elapse, and then the reaction mixture is cooled. An aqueous dispersion is obtained which has a solids content of 19.7% and an LD value of 97.

Dispersion 11

776 parts of water, 0.125 part of calcium acetate, 165 parts of hydroxypropylstarch and 13 parts of hydroxypropylcellulose are mixed under nitrogen in a polymerization apparatus fitted with reflux condenser and stirrer, and the mixture is heated with stirring to 85° C. As soon as this temperature has been reached, 0.09 part of α-amylase is added in one go. After 20 minutes, a mixture of 15 parts of glacial acetic acid and 20 parts of a 1% strength aqueous iron(II) sulfate solution is added. Following the addition of 4.17 parts of 30% strength hydrogen peroxide and of 5 parts of a 10% strength aqueous solution of the adduct of sodium bisulfite and formaldehyde, the reaction mixture is stirred for 20 minutes, and then 55.5 parts of a 45% strength aqueous solution of vinylimidazole which is quaternized with dimethyl sulfate, and 1.67 parts of 30% strength hydrogen peroxide are added. Directly thereafter, a monomer mixture comprising 37.5 parts of styrene, 18.8 parts of n-butyl acrylate and 18.7 parts of tert-butyl acrylate together with 0.25 parts of ethylhexyl thioglycolate is metered in over the course of 2 hours, and, simultaneously but separately over the course of 2.25 hours, the addition of 106 parts of a 1.4% strength hydrogen peroxide solution is commenced. After postpolymerization for one hour, 0.38 part of a 30% strength hydrogen peroxide solution is added and the reaction mixture is stirred at 85° C. for 10 minutes and then allowed to cool. An aqueous dispersion is obtained which has a solids content of 20.6% and an LD value of 98.

Dispersion 12

455.3 parts of water, 0.072 part of calcium acetate, 43 parts of hydroxypropylstarch and 7.4 parts of hydroxyethylcellulose are mixed under nitrogen in a polymerization vessel fitted with reflux condenser and stirrer, and the mixture is heated with stirring to 85° C. At this temperature, 0.045 part of α-amylase and, after 20 minutes, a mixture of 8.6 parts of glacial acetic acid and 11.4 parts of a 1% strength aqueous iron(II) sulfate solution are added. Following the addition of 2.4 parts of a 30% strength hydrogen peroxide solution, the contents of the flask are heated at 95° C. until the hydrogen peroxide has decomposed. Thereafter, the temperature is lowered to 85° C. again. Following the addition of 31.7 parts of a 45% strength aqueous solution of vinylimidazole which is quaternized with dimethyl sulfate, and 0.95 parts of a 30% strength aqueous hydrogen peroxide solution, a monomer mixture comprising 42.9 parts of styrene, 21.43 parts of n-butyl acrylate and 21.43 parts of tert-butyl acrylate together with 0.143 part of tert-dodecylmercaptan is added over the course of 2 hours and, simultaneously but separately, a feed comprising 61 parts of a 1.2% strength hydrogen peroxide solution is added over the course of 2.25 hours. Following the customary postpolymerization and cooling, an aqueous dispersion is obtained which has a solids content of 19.9% and an LD value of 92.

Dispersion 13

456 parts of water, 0.07 part of calcium acetate, 38.7 parts of hydroxypropylstarch and 11.2 parts of hydroxyethylcellulose together with 0.005 part of α-amylase are mixed under nitrogen in a polymerization vessel fitted with stirrer and reflux condenser, and the mixture is heated with stirring to 85° C. As soon as this temperature has been reached, 0.045 part of α-amylase is added, the mixture is stirred, and after exactly 20 minutes a mixture of 8.5 parts of glacial acetic acid and 11.4 parts of a 1% strength aqueous iron(II) sulfate solution is added. Following the addition of 2.4 parts of 30% strength hydrogen peroxide, the decomposition of the hydrogen peroxide is awaited. Then 31.75 parts of a 45% strength aqueous solution of vinylimidazole which is quaternized with dimethyl sulfate, and 0.95 part of a 30% strength hydrogen peroxide solution are added. Directly thereafter, the metered addition of a monomer mixture comprising 42.9 parts of styrene, 21.4 parts of n-butyl acrylate and 21.4 parts of tert-butyl acrylate is commenced. Simultaneously with the addition of the monomers, 61 parts of a 2.11% strength hydrogen peroxide solution are metered in. The monomers are metered in over the course of 2 hours and the initiator over the course of 2.5 hours. Following postpolymerization and cooling, an aqueous dispersion is obtained which has a solids content of 19.7% and an LD value of 90.

Dispersion 14

31.5 parts of glacial acetic acid are initially introduced under nitrogen into a polymerization apparatus fitted with stirrer and reflux condenser, and, with stirring and in succession, 38.3 parts of styrene, 12.6 parts of dimethylaminopropylmethacrylamide and 5.5 parts of acrylic acid are added. Following the addition of 1.5 parts of azodiisobutyronitrile, the reaction mixture is heated to a temperature of 85° C. 15 minutes after reaching 85° C., 1.5 parts of azodiisobutyronitrile are added and, after a further 15 minutes, a further 1.5 parts of azodiisobutyronitrile. After a further 30 minutes, the viscous solution is diluted with 334 parts of water containing 0.047 part of iron(II) sulfate and the reaction mixture is heated to 85° C. At this temperature, a monomer mixture comprising 50 parts of styrene, 25 parts of n-butyl acrylate and 25 parts of tert-butyl acrylate is metered in over the course of 2 hours and, simultaneously but separately, the initiator feed comprising 27 parts of a 2.5% strength solution of hydrogen peroxide is metered in over the course of 2.25 hours. The reaction mixture is then postpolymerized for 1 hour and, subsequently, cooled. An aqueous dispersion is obtained which has a solids content of 28.8% and an LD value of 99.

Dispersion 15

28.6 parts of glacial acetic acid are introduced under nitrogen into a polymerization apparatus fitted with a stirrer and a reflux condenser, and, with stirring and in succession, 29.3 parts of styrene, 9.57 parts of dimethylaminopropylmethacrylamide and 4 parts of acrylic acid are added. Following the addition of 1.5 parts of azodiisobutyronitrile, the reaction mixture is heated to 85° C. After 15 minutes, a further 1.5 parts of azodiisobutyronitrile are added, and after a further 15 minutes a further 1.5 parts of azodiisobutyronitrile. 30 minutes after the start, the viscous solution is diluted with 302 parts of water containing 0.043 part of iron(II) sulfate. The reaction mixture is then heated to 85° C. As soon as this temperature has been reached, a monomer mixture comprising 50 parts of styrene, 25 parts of n-butyl acrylate and 25 parts of tert-butyl acrylate is metered in over the course of 2 hours. 4.2 parts of a 5% strength hydrogen peroxide solution are added, and, simultaneously with the monomer feed over the course of 2.25 hours, 27 parts of a 5% strength hydrogen peroxide solution are also added. Following postpolymerization for 1 hour and subsequent cooling, a dispersion is obtained which has a solids content of 29% and an LD value of 98.

Dispersion 16

31.5 parts of glacial acetic acid are initially introduced under nitrogen into a polymerization apparatus fitted with a stirrer and a reflux condenser, and, with stirring and in succession, 39.4 parts of styrene, 12.6 parts of dimethylaminopropylmethacrylamide and 5.51 parts of acrylic acid are added. Following the addition of 1.5 parts of azodiisobutyronitrile, the mixture is heated to 85° C. 15 minutes after the start of the polymerization, a further 1.5 parts of azobutyronitrile are added and, after a further 15 minutes, a further 1.5 parts—the same quantity—of the initiator. After 30 minutes the viscous solution is diluted with 334 parts of water containing 0.047 part of iron(II) sulfate, accompanied by slow stirring and heating to 85° C. As soon as the temperature of 85° C. has been reached, a monomer mixture comprising 50.1 parts of styrene, 25 parts of n-butyl acrylate and 25 parts of methyl acrylate is metered in over the course of 2 hours. 4.5 parts by weight of a 5% strength hydrogen peroxide solution are added in one go, and 23.6 parts of a 5% strength hydrogen peroxide solution are metered in over the course of 2.25 hours. 1 hour after the end of the addition of hydrogen peroxide, the reaction mixture is postpolymerized at 85° C. and then cooled. An aqueous dispersion is obtained which has a solids content of 28.8% and an LD value of 97.

Dispersion 17 (comparison)

410 parts of water, 0.07 part of calcium acetate, 17.2 parts of a cationic potato starch, 14.9 parts of hydroxyethylcellulose and 14.3 parts of gelatin are mixed under nitrogen in a polymerization apparatus fitted with a stirrer and reflux condenser, and the mixture is heated with stirring to 85° C. Then, at this temperature, 8.6 parts of glacial acetic acid and a solution of 0.057 part of iron(II) sulfate in 5.65 parts of water are added. Following the metered addition of 4.76 parts of a 30% strength hydrogen peroxide solution, the decomposition of the hydrogen peroxide is awaited. Then 0.71 part of 30% strength hydrogen peroxide is added and, directly thereafter, the feeding-in of a monomer mixture comprising 22.7 parts of styrene, 47.3 parts of n-butyl acrylate and 30 parts of methyl acrylate is begun and, simultaneously but separately, the metered addition of 61 parts of a 1.64% strength hydrogen peroxide solution is commenced. The monomers are metered in over the course of 2 hours and the hydrogen peroxide over the course of 2.5 hours. After a postpolymerization time of 1 hour at 85° C., the reaction mixture is cooled. An aqueous dispersion is obtained which has a solids content of 19% and an LD value of 98.

Dispersion 18 (comparison)

In a reaction vessel fitted with reflux condenser and stirrer, 42.5 parts of water, 0.05 part of calcium acetate and 24.7 parts of the cationic potato starch together with 0.006 part of α-amylase are heated with stirring to 85° C. Then 0.036 part of α-amylase is added. After 20 minutes, a mixture of 5 parts of glacial acetic acid and 4.8 parts of a 1% strength solution of $FeSO_4 7H_2O$ in water is added. Thereafter, 6 parts of 5% strength hydrogen peroxide are added. After 20 minutes, a further 3.6 parts of 5% strength hydrogen peroxide are added and the feeding in of a mixture of 55 parts of acrylonitrile and 45 parts of n-butyl acrylate, and of 31.3 parts of a 5% strength hydrogen peroxide solution in water, is commenced immediately. The monomer feed is metered in over the course of 2.5 hours and that of the hydrogen peroxide over 3 hours. After the end of the feeds, postpolymerization is carried out for 1 hour and the mixture is then cooled. The dispersion has a solids content of 35.2% and an LD value of 85.

The dispersions described above were used as coating compositions for sized papers and then the suitability of the resulting papers for inkjet printing was assessed. For these tests, 2 papers were used:

Paper 1

This paper was prepared by dewatering a stock comprising 50% bleached pine sulfite pulp, 50% bleached hardwood sulfite pulp and 30% chalk, based on dry pulp. The paper was engine-sized to a Cobb value (determined in accordance with DIN 53132) of 54 g/m$^2$ and had a weight per unit area of 70 g/m$^2$. The freeness was 25° SR (Schopper-Riegler) and the ash content was 15%.

Paper 2

This test paper was obtained by dewatering a paper stock which contained 10% bleached pinewood sulfite pulp, 90% bleached hardwood sulfate pulp and 40% chalk, based on dry pulp. The paper was engine-sized to a Cobb value of 20 g/m$^2$ and had a weight per unit area of 80 g/m$^2$. The freeness was 25° SR and the ash content was 25%.

To test the dispersions described above, preparation solutions were prepared which contained, respectively, 2.5, 5, 10 and 20 g/l of copolymer of the particular dispersion to be tested (based on the solids content of the dispersions) and 60 g/l of an oxidatively degraded starch with an intrinsic viscosity of 0.36 dl/g. The liquor uptake in the case of paper 1 was about 80% and in the case of paper 2 was about 20%.

The inkjet printability properties were determined on the basis of ink density, strikethrough and showthrough on the reverse side and the water fastness of the inkjet-printed image in accordance with the methods indicated above. The results obtained with paper 1 are shown in Table 1 below, and those obtained with paper 2 are listed in Table 2.

TABLE 1

| | | Paper 1 Ink density of the front side at | | | Paper 1 Ink density after storage in water at | | | Paper 1 Ink density of the reverse side at | | |
|---|---|---|---|---|---|---|---|---|---|---|
| | Dispersion No. | 5 g/l | 10 g/l | 20 g/l | 5 g/l | 10 g/l | 20 g/l | 5 g/l | 10 g/l | 20 g/l |
| | | copolymer | | | in the preparation solution | | | in the preparation solution | | |
| Ex. No. | | | | | | | | | | |
| 1 | 1 | 1.33 | 1.55 | 1.71 | 1.27 | 1.39 | 1.55 | 0.25 | 0.1 | 0.09 |
| 2 | 2 | 1.33 | 1.61 | 1.76 | 1.18 | 1.49 | 1.59 | 0.18 | 0.09 | 0.08 |
| 3 | 3 | 1.48 | 1.83 | 1.88 | 1.51 | 1.68 | 1.59 | 0.14 | 0.08 | 0.08 |
| 4 | 4 | 1.53 | 1.75 | 1.77 | 1.08 | 1.56 | 1.62 | 0.11 | 0.08 | 0.08 |

TABLE 1-continued

| | | Paper 1 Ink density of the front side at | | | Paper 1 Ink density after storage in water at | | | Paper 1 Ink density of the reverse side at | | |
|---|---|---|---|---|---|---|---|---|---|---|
| | Dispersion No. | 5 g/l copolymer | 10 g/l copolymer | 20 g/l copolymer | 5 g/l in the preparation solution | 10 g/l in the preparation solution | 20 g/l in the preparation solution | 5 g/l in the preparation solution | 10 g/l in the preparation solution | 20 g/l in the preparation solution |
| 5 | 5 | 1.47 | 1.78 | 1.81 | 1.26 | 1.61 | 1.64 | 0.11 | 0.11 | 0.09 |
| 6 | 6 | 1.55 | 1.76 | 1.78 | 1.26 | 1.56 | 1.64 | 0.12 | 0.08 | 0.1 |
| 7 | 7 | 1.59 | 1.75 | 1.73 | 1.44 | 1.57 | 1.58 | 0.17 | 0.1 | 0.09 |
| 8 | 8 | 1.76 | 1.72 | 1.73 | 1.54 | 1.57 | 1.53 | 0.09 | 0.08 | 0.07 |
| 9 | 9 | 1.62 | 1.86 | 1.84 | 1.61 | 1.71 | 1.77 | 0.1 | 0.15 | 0.07 |
| 10 | 10 | 1.81 | 1.72 | 1.89 | 1.57 | 1.61 | 1.68 | 0.1 | 0.09 | 0.09 |
| 11 | 11 | 1.55 | 1.88 | 1.89 | 1.47 | 1.62 | 1.66 | 0.1 | 0.08 | 0.08 |
| 12 | 12 | 1.85 | 1.92 | — | 1.61 | 1.7 | — | — | — | — |
| 13 | 13 | 1.79 | 1.81 | — | 1.59 | 1.64 | — | — | — | — |
| 14 | 14 | 1.80 | 1.84 | — | 1.65 | 1.69 | — | — | — | — |
| 15 | 15 | 1.89 | 1.88 | — | 1.66 | 1.67 | — | — | — | — |
| 16 | 16 | 1.82 | 1.87 | — | 1.62 | 1.66 | — | — | — | — |
| Comp. Ex. | | | | | | | | | | |
| 1 | 17 | — | — | 1.85 | — | — | 1.23 | — | — | 0.07 |
| 2 | 18 | 1.80 | 1.80 | 1.77 | 1.43 | 1.40 | 1.37 | 0.06 | 0.05 | 0.05 |

TABLE 2

| | | Paper 2 Ink density of the front side at | | | Paper 2 Ink density after storage in water at | | | Paper 2 Ink density of the reverse side at | | |
|---|---|---|---|---|---|---|---|---|---|---|
| Ex. No. | Dispersion No. | 5 g/l copolymer | 10 g/l copolymer | 20 g/l copolymer | 5 g/l in the preparation solution | 10 g/l in the preparation solution | 20 g/l in the preparation solution | 5 g/l in the preparation solution | 10 g/l in the preparation solution | 20 g/l in the preparation solution |
| 17 | 12 | 1.79 | 1.84 | 1.88 | 1.56 | 1.76 | 1.78 | 0.07 | 0.07 | 0.07 |
| 18 | 13 | 1.7 | 1.75 | 1.76 | 1.47 | 1.48 | 1.55 | 0.07 | 0.02 | 0.02 |

We claim:

1. A process for the preparation of a recording material comprising applying an aqueous coating composition to one or both sides of a sheet of paper for an inkjet printer wherein said coating composition is an aqueous dispersion consisting essentially from 20 to 200 g/l of starch and from 0.5 to 50 g/l of a copolymer formed by emulsion copolymerization of 100 parts by weight of a monomer mixture consisting essentially of (a) from 10 to 65 parts by weight of a monomer selected from the group consisting of styrene, α-methylstyrene, acrylonitrile, methacrylonitrile, and mixtures thereof, (b) from 30 to 85 parts by weight of a monomer selected from the group consisting of acrylic ester with a $C_1$–$C_{18}$ alcohol, methacrylic ester with a $C_1$–$C_{18}$ alcohol and mixtures thereof, (c) from 5 to 25 parts by weight of a monomer containing a tertiary, quaternary amino group, or a mixture thereof, and (d) from 0 to 20 parts by weight of another monoethylenically unsaturated monomer in an aqueous medium in the presence of from 12 to 300% by weight, based on said monomer mixture, of at least one natural or synthetic protective colloid.

2. The process as claimed in claim 1, wherein the synthetic protective colloids employed are polyvinyl alcohol, polyvinylpyrrolidone and/or water-soluble cationic copolymers which contain tertiary and/or quaternary amino groups.

3. The process of claim 1, wherein said synthetic protective colloid is prepared by solution polymerization of a monomer mixture comprising (1) from 40 to 80% by weight of a monomer selected from the group consisting of styrene, acrylonitrile, methacrylonitrile, acrylic or methacrylic ester of $C_4$–$C_{18}$ alcohols and mixtures thereof, (2) from 15 to 50% by weight of a monomer containing a tertiary, quaternary amino group, or a mixture thereof and (3) from 5 to 25% by weight of a monomer selected from the group consisting of acrylic acid, methacrylic acid, acrylamide, methacrylamide and mixtures thereof in a solvent selected from the group consisting of a saturated $C_1$–$C_5$-carboxylic acid, an ester of said carboxylic acid with a saturated $C_1$–$C_6$ alcohol, a saturated $C_1$–$C_6$ alcohol, a saturated ketone and mixtures thereof.

4. The process as claimed in claim 1, wherein natural protective colloids employed are hydroxyethylcellulose, hydroxyethyl-starch and/or hydroxypropylstarch.

5. The process of claim 1, wherein the protective colloid is used in quantities of from 25 to 160% by weight, based on the total monomer mixture.

6. A process for the preparation of a recording material comprising applying an aqueous coating composition to one or both sides of a sheet of paper for an inkjet printer wherein said coating composition is an aqueous dispersion consisting essentially from 20 g/l to 200 g/l of starch and from 0.5 to 50 g/l of a copolymer formed by emulsion copolymerization of 100 parts by weight of a monomer mixture consisting essentially of (a) from 10 to 65 parts by weight of a monomer selected from the group consisting of styrene, α-methylstyrene, acrylonitrile, methacrylonitrile, and mixture thereof, (b) from 30 to 85 parts by weight of a monomer selected from the group consisting of acrylic ester with a $C_1$–$C_{18}$ alcohol, methacrylic ester with a $C_1$–$C_{18}$ alcohol and mixtures thereof, (c) from 0 to 25 parts by weight of a monomer containing tertiary amino group, a monomer containing a quaternary amino group, or a mixture thereof, and (d) from 0 to 20 parts by weight of another monoethylenically unsaturated monomer in an aqueous medium in the presence of from 12 to 300% by weight, based on total monomer mixture, of a synthetic cationic protective colloid.

* * * * *